US011754370B2

(12) United States Patent
Mogle et al.

(10) Patent No.: US 11,754,370 B2
(45) Date of Patent: Sep. 12, 2023

(54) ELECTRONIC ARCHERY SIGHTS

(71) Applicant: Bear Archery, Inc., Evansville, IN (US)

(72) Inventors: James Mogle, Evansville, IN (US); David Alsip, Evansville, IN (US); David Hahn, Elberfeld, IN (US); Andrew Hughes, Evansville, IN (US)

(73) Assignee: Bear Archery, Inc., Evansville, IN (US)

( * ) Notice: Subject to any disclaimer, the term of this patent is extended or adjusted under 35 U.S.C. 154(b) by 177 days.

(21) Appl. No.: 17/303,205

(22) Filed: May 24, 2021

(65) Prior Publication Data

US 2021/0389084 A1 Dec. 16, 2021

Related U.S. Application Data

(60) Provisional application No. 62/705,108, filed on Jun. 11, 2020.

(51) Int. Cl.
*F41G 1/467* (2006.01)
*F41G 1/44* (2006.01)

(52) U.S. Cl.
CPC ..... *F41G 1/44* (2013.01); *F41G 1/467* (2013.01)

(58) Field of Classification Search
CPC ..... F41G 1/44; F41G 1/467
USPC ..... 33/265; 124/87
See application file for complete search history.

(56) References Cited

U.S. PATENT DOCUMENTS 5,836,294 A * 11/1998 Merritt ..... F41G 1/467 124/87
5,914,775 A * 6/1999 Hargrove ..... G01C 3/08 356/3.13
6,073,352 A * 6/2000 Zykan ..... F41G 1/473 33/DIG. 21
6,079,111 A * 6/2000 Williams ..... F41G 1/467 124/87
6,802,129 B1 * 10/2004 Wirth ..... F41G 1/467 124/87
7,513,050 B2 * 4/2009 Kroening, Jr. ..... F41G 1/467 124/87
7,614,156 B1 * 11/2009 Imig ..... F41G 1/467 124/87
7,743,518 B2 * 6/2010 Khoshnood ..... F41G 1/467 124/87
7,877,885 B2 * 2/2011 Davis ..... F41G 1/467 124/87
8,166,962 B2 * 5/2012 Volpe ..... F41G 1/467 124/87
8,272,137 B2 * 9/2012 Logsdon ..... F41G 1/345 124/87
8,276,282 B2 * 10/2012 Mainsonneuve ..... F41G 1/467 124/87
8,286,771 B2 10/2012 Takada et al.
(Continued)

*Primary Examiner* — Alexander R Niconovich
(74) *Attorney, Agent, or Firm* — Woodard. Emhardt, Henry, Reeves & Wagner, LLP

(57) ABSTRACT

Aspects of the present disclosure deal with archery sights mounted or mountable on an archery bow. The sight incorporates a sight pin and an adjustment assembly in combination with an electronic module to indicate or control the desired position of the sight pin. The electronic module calculates and displays correlated target distances based on the position of the sight pin.

8 Claims, 12 Drawing Sheets

(56) References Cited

U.S. PATENT DOCUMENTS

| | | | | |
|---|---|---|---|---|
| 8,316,551 | B2 * | 11/2012 | Gorsuch | F41G 1/467 124/87 |
| 8,336,216 | B2 * | 12/2012 | Samuels | G01C 3/06 124/87 |
| 8,561,308 | B2 * | 10/2013 | Adams | F41B 5/14 124/87 |
| 8,596,257 | B2 | 12/2013 | Volpe | |
| 8,619,238 | B2 * | 12/2013 | Overstreet | G01S 3/08 356/3.01 |
| 8,640,349 | B2 * | 2/2014 | Wasilewski | F41G 1/467 124/87 |
| 8,739,419 | B1 * | 6/2014 | Pulkrabek | F41G 1/467 124/87 |
| 8,919,000 | B2 | 12/2014 | Samuels et al. | |
| 9,004,056 | B2 | 4/2015 | Volpe | |
| 9,441,913 | B1 * | 9/2016 | Donahoe | F41G 1/54 |
| 9,448,036 | B2 | 9/2016 | Samuels et al. | |
| 9,513,085 | B2 * | 12/2016 | Hahn | F41G 1/033 |
| 9,518,803 | B2 * | 12/2016 | Wassmer | F41G 1/467 |
| 9,568,278 | B1 * | 2/2017 | Jordan | F41G 1/467 |
| 9,777,993 | B1 * | 10/2017 | Donahoe | F41G 1/467 |
| 10,302,393 | B2 * | 5/2019 | Grace, Jr. | H10N 10/17 |
| 10,670,372 | B2 * | 6/2020 | VanCamp | F41G 1/30 |
| 2009/0165314 | A1 * | 7/2009 | Khoshnood | F41G 1/467 33/265 |
| 2010/0258628 | A1 * | 10/2010 | Bay | F41G 1/35 235/404 |
| 2013/0133213 | A1 | 5/2013 | Gorsuch et al. | |
| 2019/0101357 | A1 * | 4/2019 | VanCamp | F41G 3/323 |
| 2020/0232764 | A1 * | 7/2020 | Macdonald | F41G 1/467 |

* cited by examiner

ELECTRONIC ARCHERY SIGHTS

This application claims the benefit of provisional application Ser. No. 62/705,108 filed on Jun. 11, 2020, which is incorporated herein by reference.

FIELD OF THE DISCLOSURE

Aspects of the present invention deal with archery bows, and in particular deal with accessories such as sights usable with archery bows.

BACKGROUND

A bow sight can be used to assist an archer in aiming a bow. A typical bow sight includes a sight housing secured to the frame of a bow by one or more brackets. The sight housing often defines a viewing opening (i.e., a sight window) through which an archer can frame a target. The bow sight also typically includes at least one sighting member, such as a pin, that projects into the viewing opening. The sighting member defines and supports a sight point. The sight point is the point the archer aligns with the target during aiming. In use, the archer draws the drawstring of the bow and adjusts the position of the bow so that the intended target is visible through the viewing opening. While continuing to peer through the viewing opening with the bowstring drawn, the archer adjusts the position of the bow so that the sight point aligns with the intended target from the archer's eye. Once the sight point is aligned with the intended target, the archer releases the bowstring to shoot the arrow. "Target" herein can mean either a target being hunted or a fixed target. One example of a vertically adjustable sight is illustrated in U.S. Pat. No. 7,275,328.

The vertical positions for multiple sight points or multiple positions for a single adjustable sight point are preferably set and calibrated to the user and bow so that each sight point position corresponds to a different target distance. Multiple sighting members are generally arranged in either a vertically aligned orientation, such as discussed in U.S. Pat. No. 6,418,633 or a horizontal orientation, such as discussed in U.S. Pat. No. 5,103,568. In certain embodiments, the sight points can be adjusted vertically to calibrate the sight points for differing target distances. Lower sight point positions typically correspond to longer target distances.

Adjustment of multiple sight pins or multiple positions for a single adjustable sight point for different target distances often involves an archer, through trial and error, "sighting in" the bow at each distance so that each sight point position is accurately associated with a particular target distance. The target distances corresponding to different sight pin heights or sight pin positions is proportional rather than linear. In other words, there is not a one-to-one ratio between different sight point positions and corresponding target distances. An alternate approach is to use computer software based on bow speed and other variables to prepare and print a sight tape which is then mounted on the bow sight and provides guidance for individually adjusting sight pins for various target distances. A still alternate approach, as discussed in U.S. Pat. No. 7,392,590, uses a multi-pitch lead screw to simultaneously proportionately adjust multiple sight pins.

U.S. Pat. No. 9,513,085 discloses a sight which incorporates an internal adjustable body portion with proportionately curved spiral tracks. Rotating the body portion proportionally adjusts the spacing between different target distance indicators. Once calibrated, the body portion is preferably locked in place. A separate knob is used to adjust the height of a single sight point and a corresponding pointer to align the pin with the different target distance indicators, which correspondingly adjusts the sight point to different target distances (10 yards, 20 yards, 30 yards, etc.).

SUMMARY

Embodiments of the present disclosure include sights for archery bows. The sight includes at least one sight pin defining a sight point within a sight cover. Once properly calibrated, a control knob or dial can be turned to adjust the sight pin and sight point to different heights. The sight electronically measures the amount of height adjustment and digitally displays a calculated target distance based on the proportional distance between a known height and the adjusted height.

The sight pin height can be adjusted using a control knob and shaft to move the sight cover height. Starting from the top-most position at a starting target distance (e.g. 20 yards), the electronic module measures the angular rotation of the shaft, which corresponds to the height adjustment distance of the sight pin. Based on the amount of shaft rotation, the electronic module calculates and displays the target distance for the corresponding sight pin height (e.g. 21 yards, 22 yards, . . . 25 yards, . . . 30 yards, etc.).

One method of measuring the degrees of rotation is based on a magnet mounted to the internal end of the adjustment knob shaft. At least one sensor within the electronic module measures the rotation of the magnet, allowing the corresponding pin height to be known and allowing the electronic module to calculate and display the respective target distance.

The disclosure includes two methods of calibrating the sight. In the "two distance" method, the sight is first calibrated using test shots so that the pin is aligned for a first fixed distance. The pin is then adjusted so it is calibrated and aligned for a second fixed distance. Both distances are known. Once the proportional pin height spacing for two known distances is known, the electronic module can calculate and indicate other target distances based on the sight pin's then-current position relative to one of the known distance points, typically the first fixed distance point.

In a second "bow speed" method, the sight is also first calibrated so the pin is aligned for a first fixed distance. Then, if the bow speed (i.e. arrow launch speed) is known, the bow speed is programmed in the electronic module's memory. Thereafter as the sight pin height is changed, the electronic module can calculate and display the corresponding target distance. If the bow speed is only approximately known, the archer can iteratively enter different bow speeds into the memory and then test the results to achieve proper target indications.

Other objects and attendant advantages will be readily appreciated, as the same become better understood by reference to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the disclosure relates.

Embodiments of the present disclosure include sights for archery bows. The sight has at least one sight pin defining a sight point. Once properly calibrated, a knob or dial can be turned to adjust the sight pin to different heights. The sight electronically measures the amount of adjustment and then calculates and displays a target distance correlated to the adjusted sight pin height.

Figure 1:
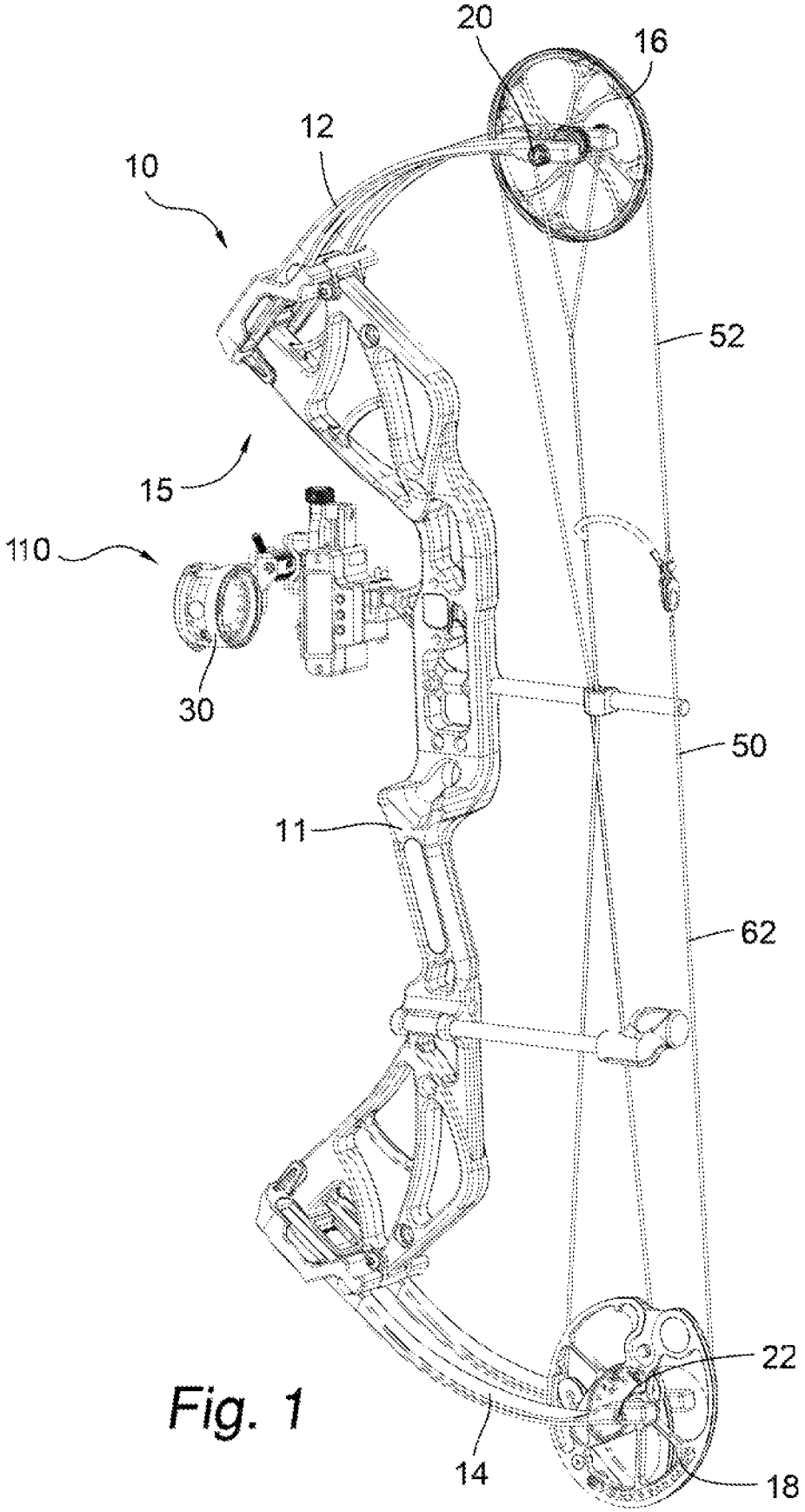
FIG. 1 is a representative embodiment of an archery bow with an archery sight according to an embodiment of the present disclosure.
Figure 2:
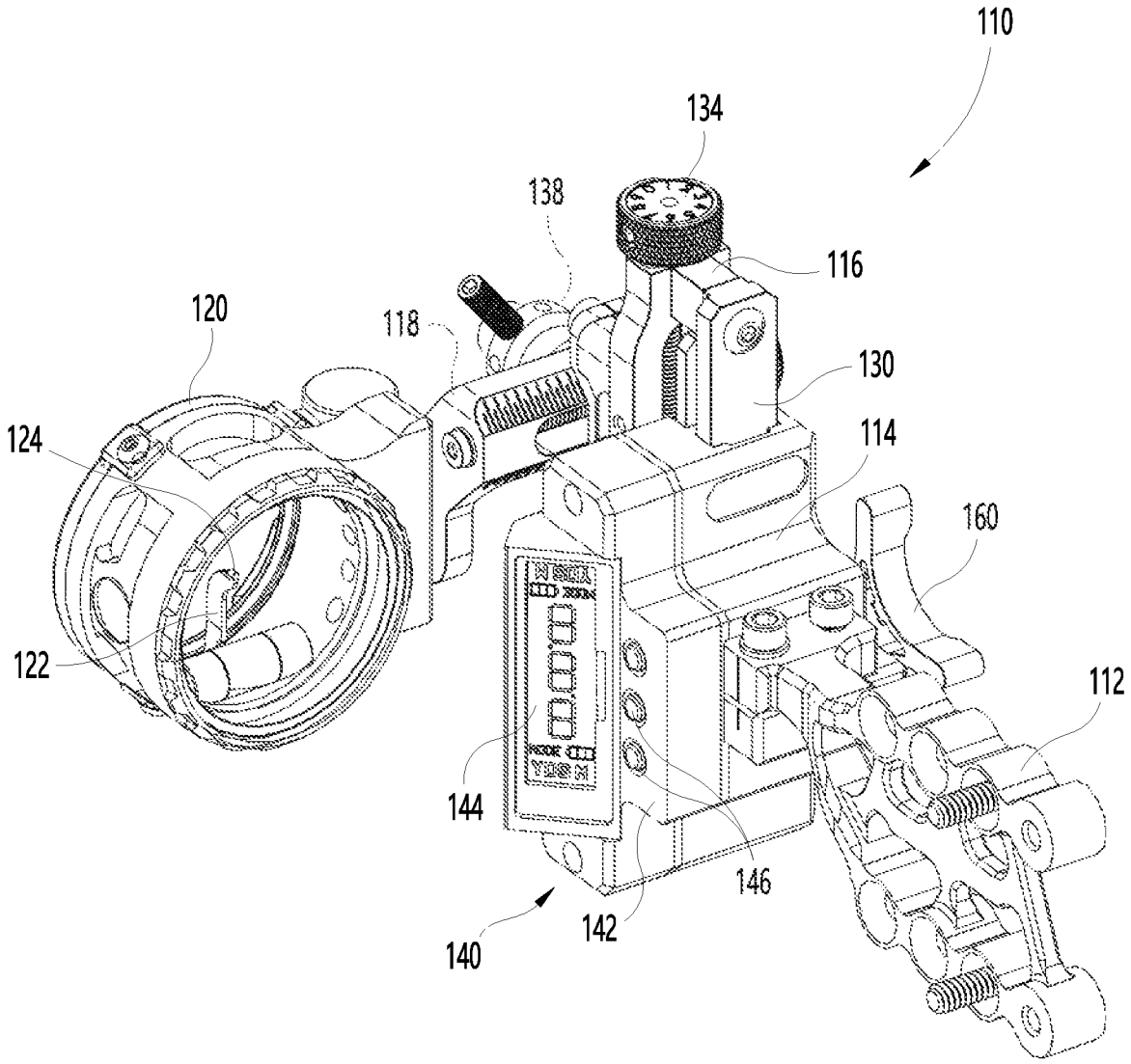
FIG. 2 is a perspective view of an archery sight according to an embodiment of the present disclosure.
Figure 3:
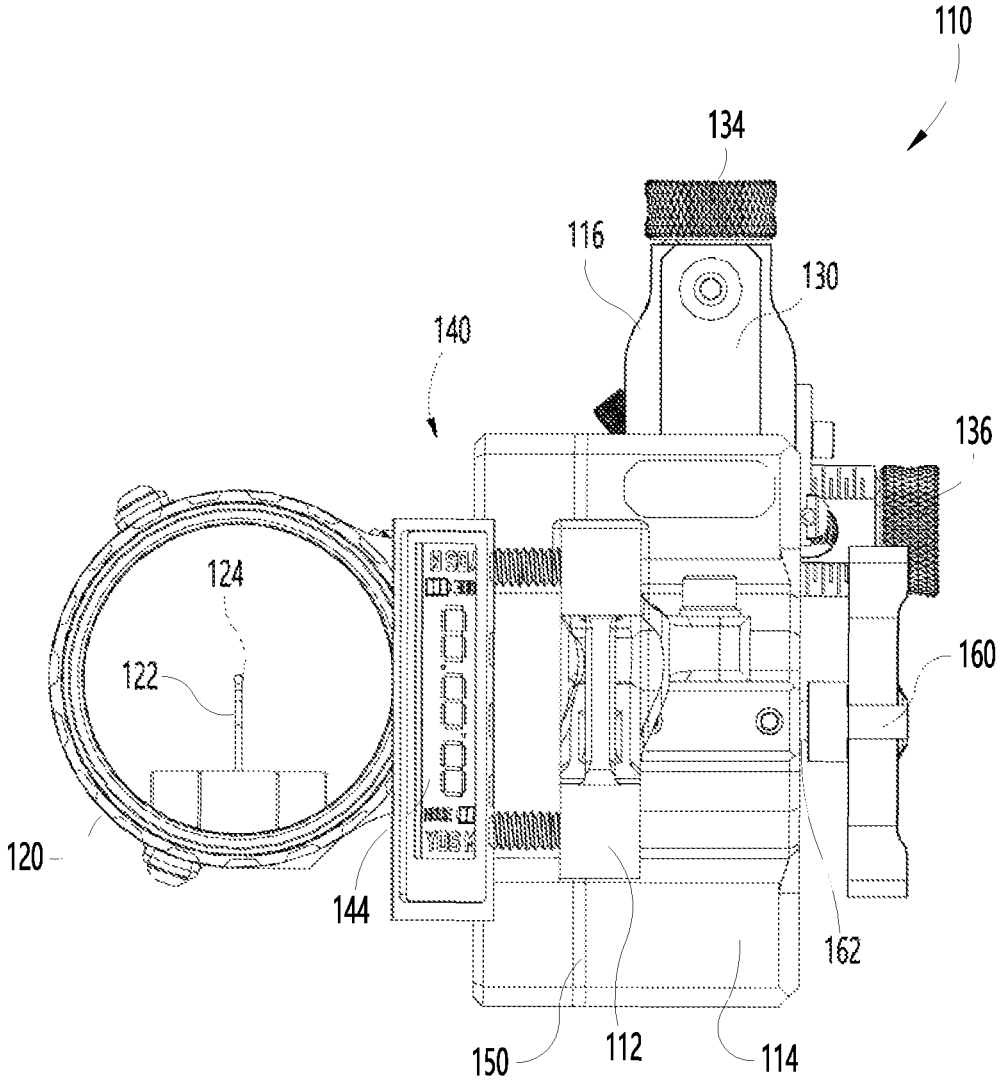
FIG. 3 is rear view of the archery sight of FIG. 2.
Figure 4:
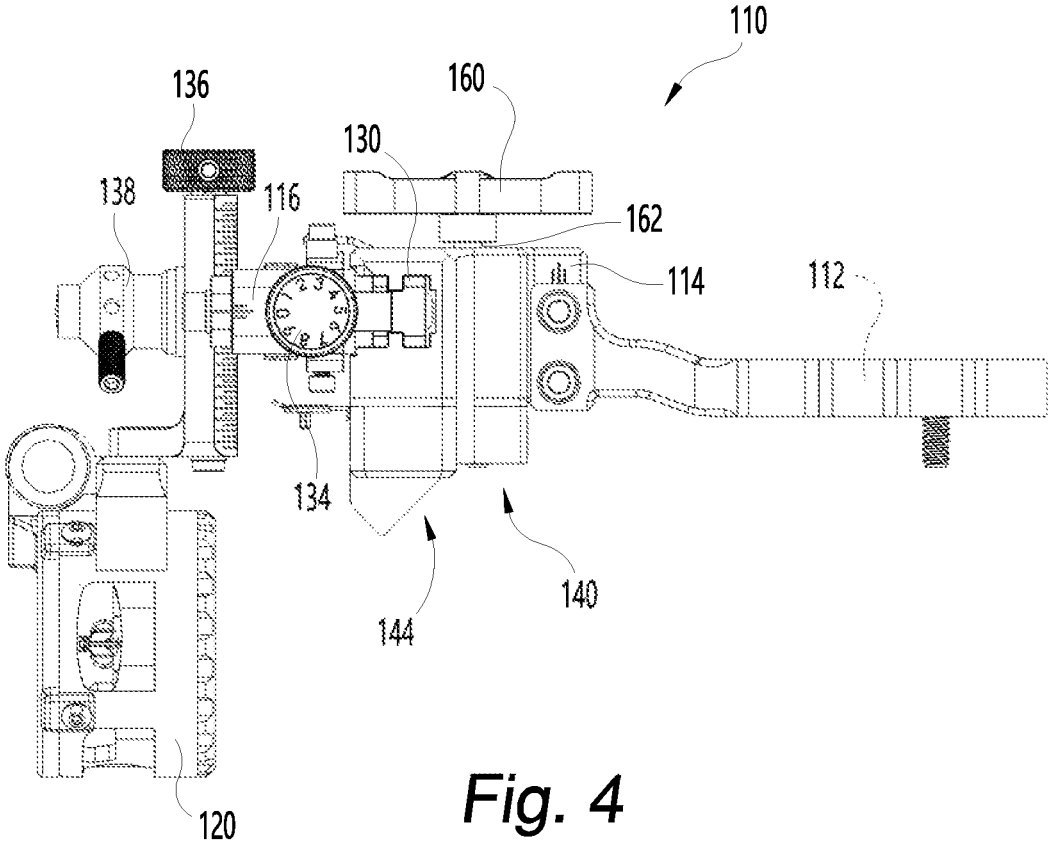
FIG. 4 is top view of the archery sight of FIG. 2.
Figure 5:
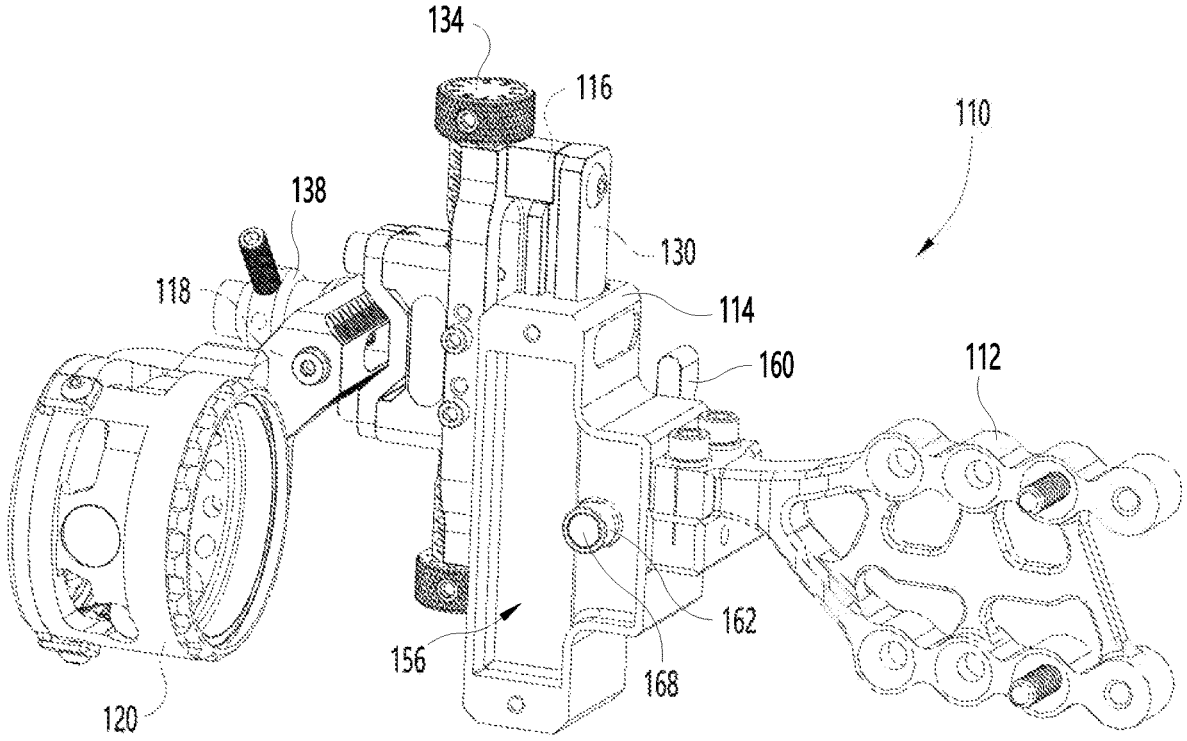
FIG. 5 is perspective view of the archery sight of FIG. 2 with the electronic module removed.

FIG. 1 illustrates a representative example of an archery bow 10 incorporating an archery sight 110 according to the present disclosure. Bow 10 includes a riser 11 with a handle, an upper limb or pair of limbs 12 and a lower limb or pair of limbs 14. In the embodiment shown, upper and lower limbs are formed of parallel and symmetric limbs sometimes called a quad limb arrangement. Alternately, a single piece limb can have a notch or slot area removed to allow a rotational element to be mounted to the limb tips. In the single cam example illustrated, rotational members such as idler wheel 16 and eccentric cam 18 are supported at the limb tip sections for rotary movement about axles 20 and 22. An upper pulley axle 20 is carried between the outer limb tip portions of upper limb 12. A lower pulley axle 22 is carried between the outer limb tip portions of lower limb 14.

The portion of the cable which defines the bowstring 50 includes an upper portion 52 and a lower portion 62 which are fed-out from idler wheel 16 and cam 18 when the bow is drawn. The upper portion 52 may be part of a longer cable which has a medial portion mounted around idler wheel 16 with the ends mounted to cam 18. The non-bowstring portion of the cable extending from wheel 16 to cam 18 can be referred to as the return cable portion. Additionally, a y-yoke anchor cable has a lower end mounted to cam 18 which extends to two upper ends mounted adjacent opposing ends of axle 20. Each cable has a thickness and a round cross-section defining a circumference. From the perspective of the archer, the bowstring is considered rearward relative to the riser which defines forward.

When the bowstring 50 is drawn, it causes idler wheel 16 and cam 18 at each end of the bow to rotate, feeding out cable and bending limbs 12 and 14 inward, causing energy to be stored therein. When the bowstring 50 is released with an arrow engaged to the bowstring, the limbs 12 and 14 return to their rest position, causing idler wheel 16 and cam 18 to rotate in the opposite direction, to take up the bowstring 50 and launch the arrow with an amount of energy proportional to the energy initially stored in the bow limbs. Bow 10 is described for illustration and context and is not intended to be limiting.

While not illustrated, embodiments of the present disclosure can also be used in other types of bows, for example dual cam or two cam bows, hybrid cam bows or recurve bows which are considered conventional for purposes of the present disclosure. For convenience, the combination of riser 11 and either single or quad limbs forming upper limb 12 and lower limb 14 may generally be referred to as archery bow body 15. Accordingly, it should be appreciated that the archery bow body can take on various designs in accordance with the many different types of bows with which the present disclosure can be used.

Various accessories, such as arrow rests, stabilizers and quivers can be mounted to bow body 15. Commonly, sight 110 is used in combination with a peep sight. Sight 110 is typically mounted to or formed as part of riser 11 above the arrow rest position. The sight 110 defines at least one aiming point.

Sight pin adjustment mechanisms according to preferred embodiments herein assist an archer to calibrate a single adjustable aiming point such as a sight pin to different reference or target distances. The spacing of the respective pin positions for different yardages follows a proportional spacing pattern governed by the range formula. Using laws of physics and geometry, the range formula can be applied to calculate the travel of an arrow from an archery bow where the horizontal distance travelled is proportional to the bow speed and angle of launch. More specifically, a formula of:

$$x=(v^2 \sin 2\theta)/g^2$$

applies where "x" is the horizontal distance of travel, "v" is the launch velocity of the arrow from the bow or bow speed, "θ" is the angle of launch and "g" is the acceleration due to gravity. Assuming a bow with a consistent launch velocity, the respective launch angle θ for a specified distance can be calculated using the bow speed. For instance:

$$10 \text{ yds}=(v^2 \sin 2\theta_1)/g^2$$

$$20 \text{ yds}=(v^2 \sin 2\theta_2)/g^2$$

$$30 \text{ yds}=(v^2 \sin 2\theta_3)/g^2$$

For purposes of the present mechanism, a reference or zero degree line for calculating the angle of arrow launch can be defined as a horizontal line extending from a point closely adjacent to the archer's eye, through the sight, intersecting the sight pin and then to a target point at a first defined distance. The distance from the archer's eye to the sight pin is proportional to the draw length of the bow and is assumed to be constant for a specific archer and bow. For example, when a first sight pin on a 27" draw length bow is calibrated at 10 yards, the zero degree line $\theta_1$ can be defined as a line including approximately 27" from the archer's eye to the first sight pin position plus 10 yards to a target. Using the above formula and knowing the velocity of the bow, the angles $\theta_2$, $\theta_3$, $\theta_4$, . . . for additional target distances such as 20, 30, 40 yards, etc. relative to the reference line and the archer's eye can also be calculated. Angles $\theta_2$, $\theta_3$, $\theta_4$, . . . can then be applied using the distance from the archer's eye to the sight to define the offset height of the sight pin relative to the first sight pin position corresponding to respective target distance. Offset heights for longer distances are typically measured downward relative to a pin position calibrated for a shorter distance.

For example, in a "two distance" calibration method, the sight is first calibrated using test shots so that the pin is aligned for a first fixed distance. The pin is then adjusted and test shots are used to calibrate it for a second fixed distance. Both distances are known. Once the proportional pin height spacing for two known distances is known, the electronic module can calculate and indicate other target distances based on the sight pin's position relative to the proportional spacing determined during the calibration process.

In a second "bow speed" method, the sight is first calibrated so the pin is aligned for a first fixed distance. Then, if the bow speed (i.e. arrow launch speed) is known, the archer enters the bow speed into the memory of the electronic module. The electronic module can then calculate the corresponding target distances based on the proportional spacing of the sight pin between the first fixed distance and the then-current position. If the bow speed is only approximately known, the archer can iteratively enter different bow speeds and test the results until the electronic module displays accurate target indications.

Once the sight is calibrated, when the sight pin height is adjusted the electronic module senses and measures the amount of height adjustment. The electronic module then calculates and then precisely displays the target distance proportionally corresponding to the then-current sight pin height (e.g. 21 yards, 22 yards, . . . 25 yards, . . . 30 yards, etc.). In certain embodiments, the electronic module is able to precisely indicate target distances in a continuous range based on substantially the entire height range within which the sight pin can be adjusted.

FIGS. 2-5 illustrate views of a representative embodiment of an electronic archery sight 110. Archery sight 110 includes a base 112 configured to be mounted to an archery bow riser 11, for example with fasteners such as screws or bolts. Alternately, base 112 could be an integrated portion of an archery bow riser. A forward end of base 112 is mounted to or integrally connected to sight housing 114. Bracket arrangement 116 is adjustably coupled to a forward end of housing 114. Bracket arrangement 116 includes a windage arm 118 extending laterally. A sight cover 120 is mounted to a lateral end of windage arm 118. Sight cover 120 defines a viewing window or sight window. At least one sight pin 122 is mounted within sight cover 120. Sight pin 122 extends from a base to a sight point 124 in a central area of sight cover 120. As examples, sight point 124 can be a terminal point, the end of a fiber optic filament or an aperture.

In the illustrated embodiment, bracket arrangement 116 includes a vertical slider 130 mounted within a vertical track in the forward end of sight housing 114. Vertical slider 130 can be adjusted along a vertical axis relative to sight housing 114 to correspondingly adjust the height bracket arrangement 116. Control knob 160 can be rotated to controllable adjust the height of slider 130. In certain embodiment, a knurled knob is located in the interior of sight housing 114 and mounted to a horizontal shaft 162 controlled by knob 160. The circumference of the knurled knob engages a surface of slider 130 in a tangential manner such that rotation of the knurled knob causes a corresponding vertical height change in slider 130. Changing the height of slider 130 correspondingly changes the height of bracket arrangement 116 and by extension the height of sight pin 122. In an alternate embodiment, slider 130 incorporates a rack gear which engages a pinion gear on shaft 162 inside sight housing 114 and.

Bracket arrangement 116 incorporates a micro-height adjustment mechanism controlled by knob 134 for use in initially calibrating the height of sight point 124. Bracket arrangement 116 further includes a windage adjustment mechanism controlled by knob 136 and lock 138. Knob 136 can be used to adjust the lateral extension distance of windage arm 118 and correspondingly sight point 124 relative to sight housing 114. Lock 138 secures the windage arm 118 in place once adjusted.

Figure 7:
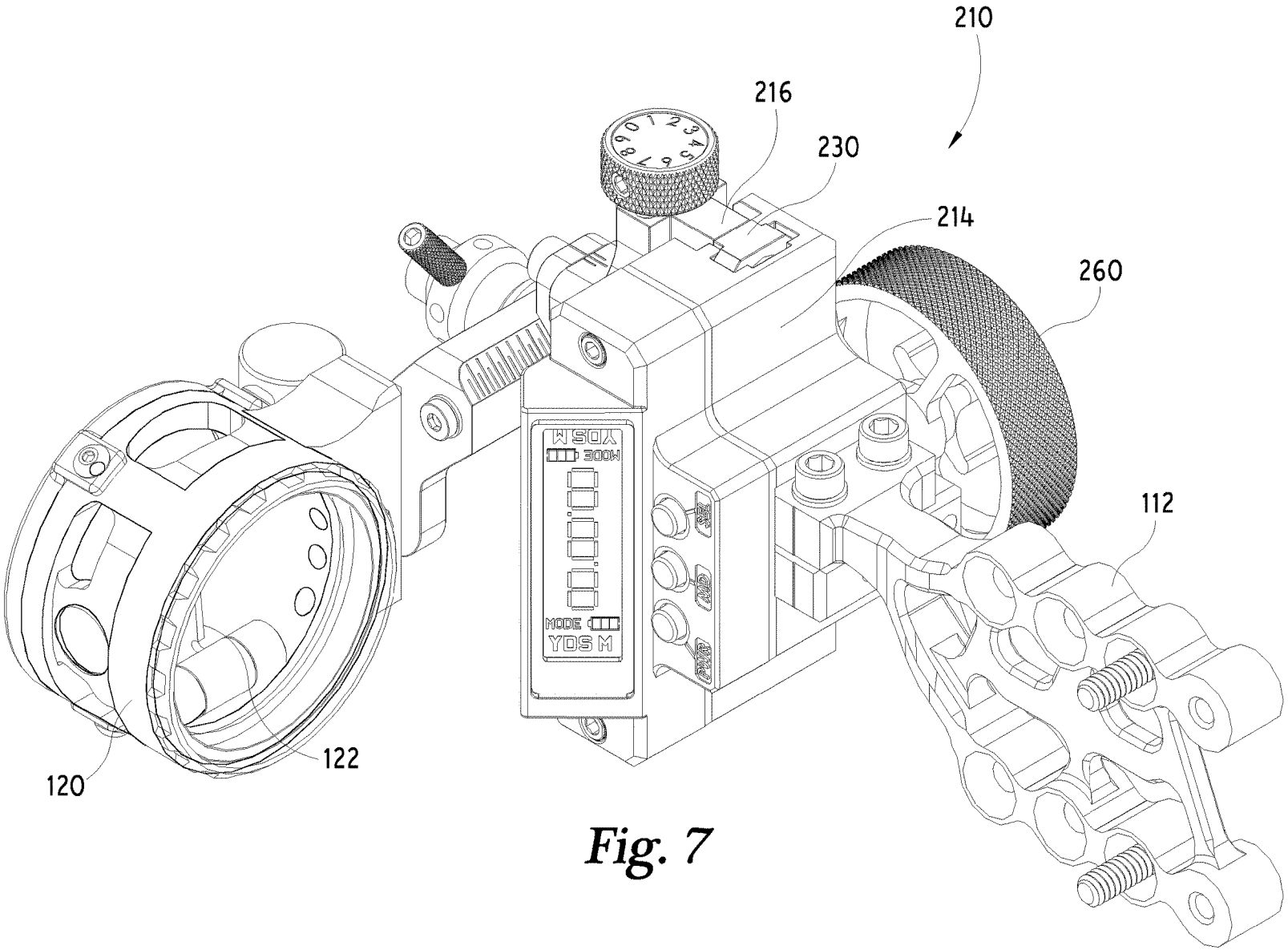
FIG. 7 is a perspective view of an archery sight according to an embodiment of the present disclosure.
Figure 8:
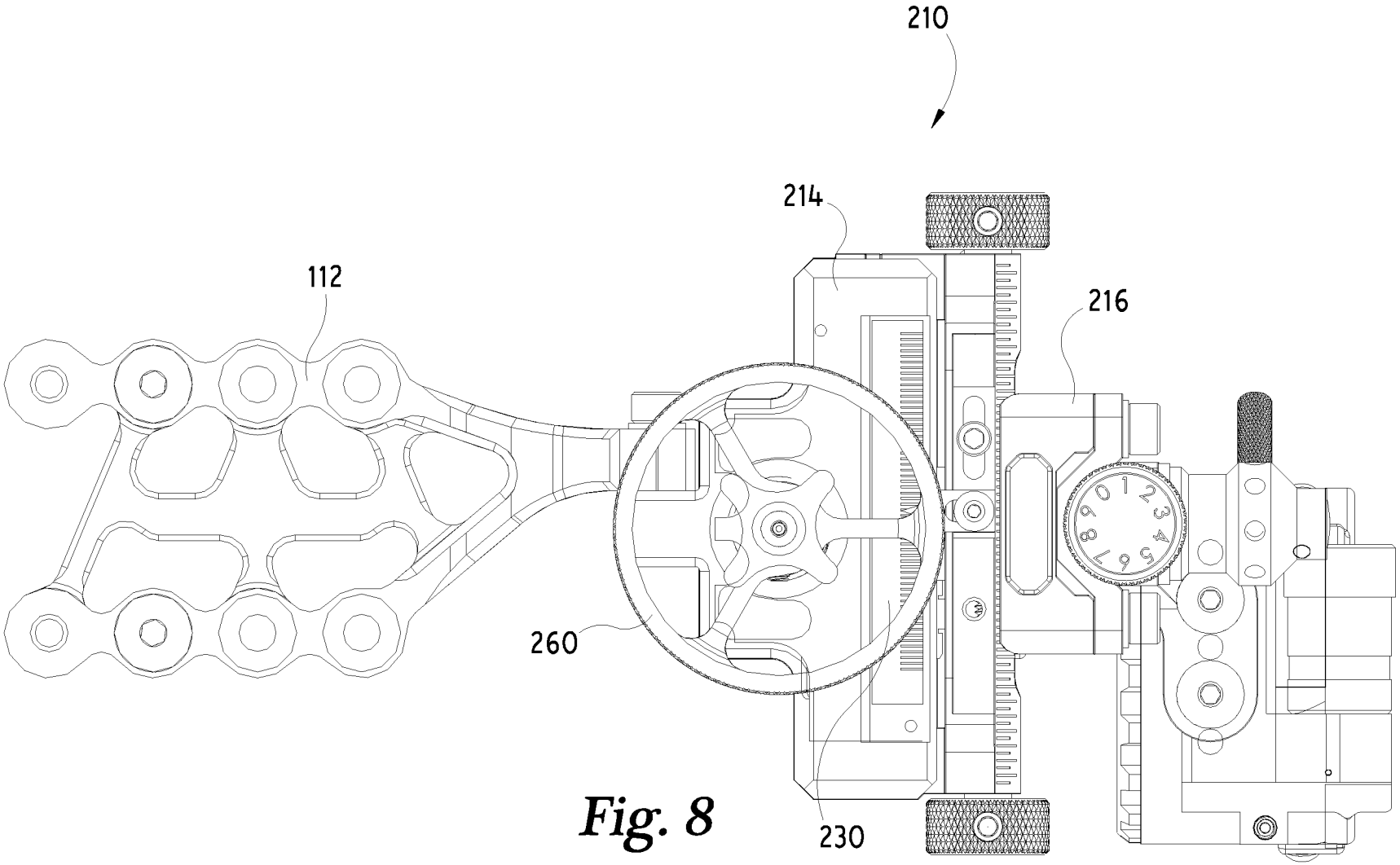
FIG. 8 is a side view of the archery sight shown in FIG. 7.
Figure 9:
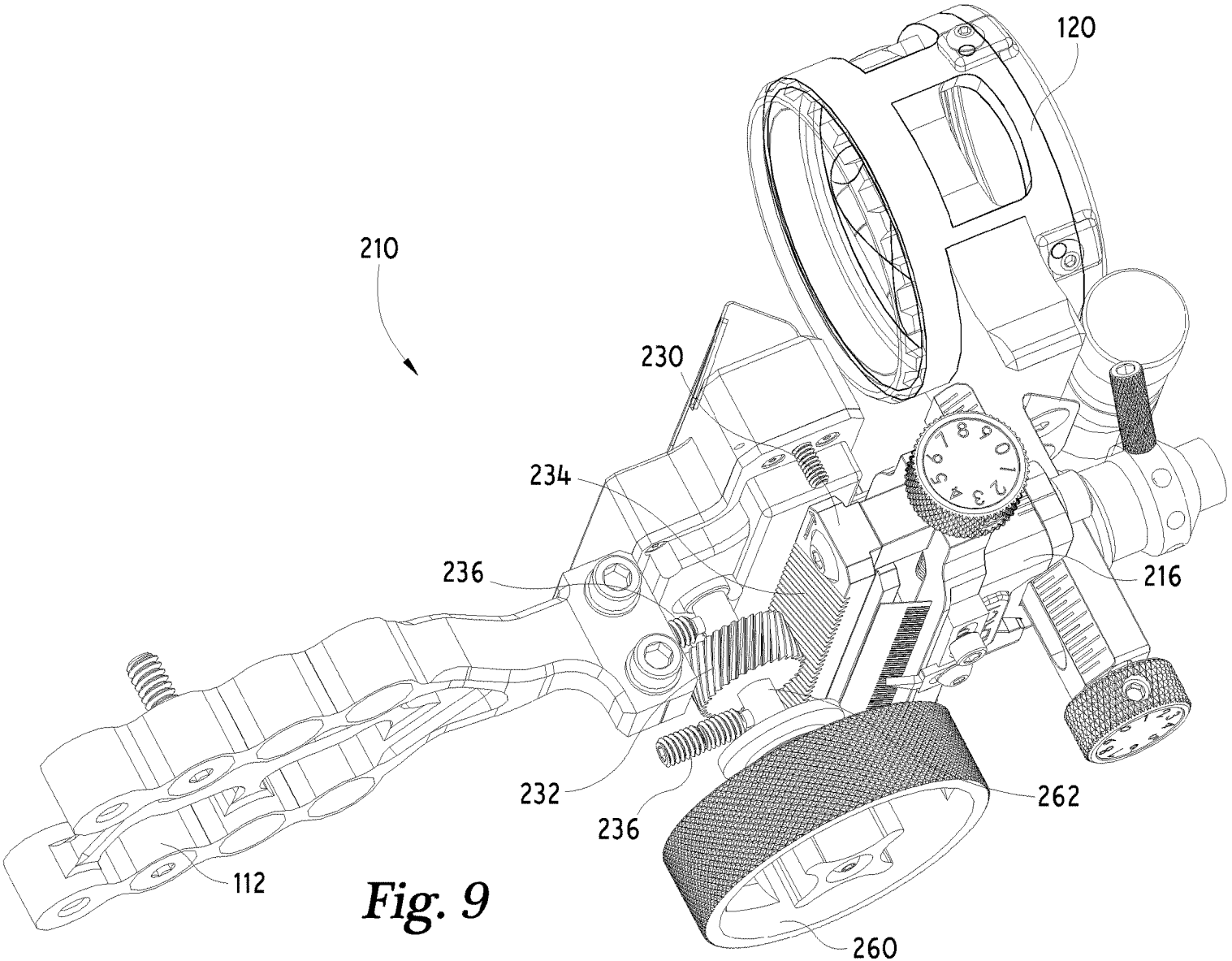
FIG. 9 is a perspective view of the archery sight of FIG. 7 with the housing removed to illustrate an internal view.

FIGS. 7-9 illustrate views of an alternate embodiment of an electronic archery sight 210. Archery sight 210 in constructed in the same manner as archery sight 110 except for the vertical slider and control knob arrangement. Archery sight 210 includes a base 112 configured to be mounted to an archery bow riser 11. A forward end of base 112 is mounted to or integrally connected to sight housing 214. Bracket arrangement 216 is adjustably coupled to a forward end of housing 214. Bracket arrangement 2015 includes a windage arm which extends laterally from the bracket arrangement to a sight cover 120. Sight cover 120 defines a viewing window or sight window. At least one sight pin 122 is mounted within sight cover 120.

In the illustrated embodiment, bracket arrangement 216 includes a vertical slider 230 mounted within a vertical track in the forward end of sight housing 214. Vertical slider 230 can be adjusted along a vertical axis relative to sight housing 214 to correspondingly adjust the height of the sight cover, sight pin and sight point. Control knob 260 can be rotated to controllable adjust slider 230. Control knob 260 has a larger diameter than control knob 160, allowing more precise control.

FIG. 9 is illustrated with housing 214 omitted to illustrate an internal view. As visible in FIG. 9, pinion gear 232 is located in the interior of sight housing 114 and mounted to a horizontal shaft 262 controlled by control knob 260. The pinion gear 232 engages a vertical rack gear 234 on slider 230 in a tangential manner such that rotation of the pinion gear causes a corresponding vertical height change in rack gear 234 and slider 230. In the illustrated embodiment, pinion gear 232 is helical and rack gear 234 has angled slots in which the pinion and rack gears engage and intermesh.

Optionally, yet preferably, a pair of set screws 236 are mounted in sight housing 214. Set screws 236 are positioned so that their inner ends abut or are closely adjacent to shaft 262. Set screws 236 brace shaft 262 against a rearward rebound or bending movement and assist in holding the rack and pinion gears in engagement, for instance when an arrow is released.

Figure 10:
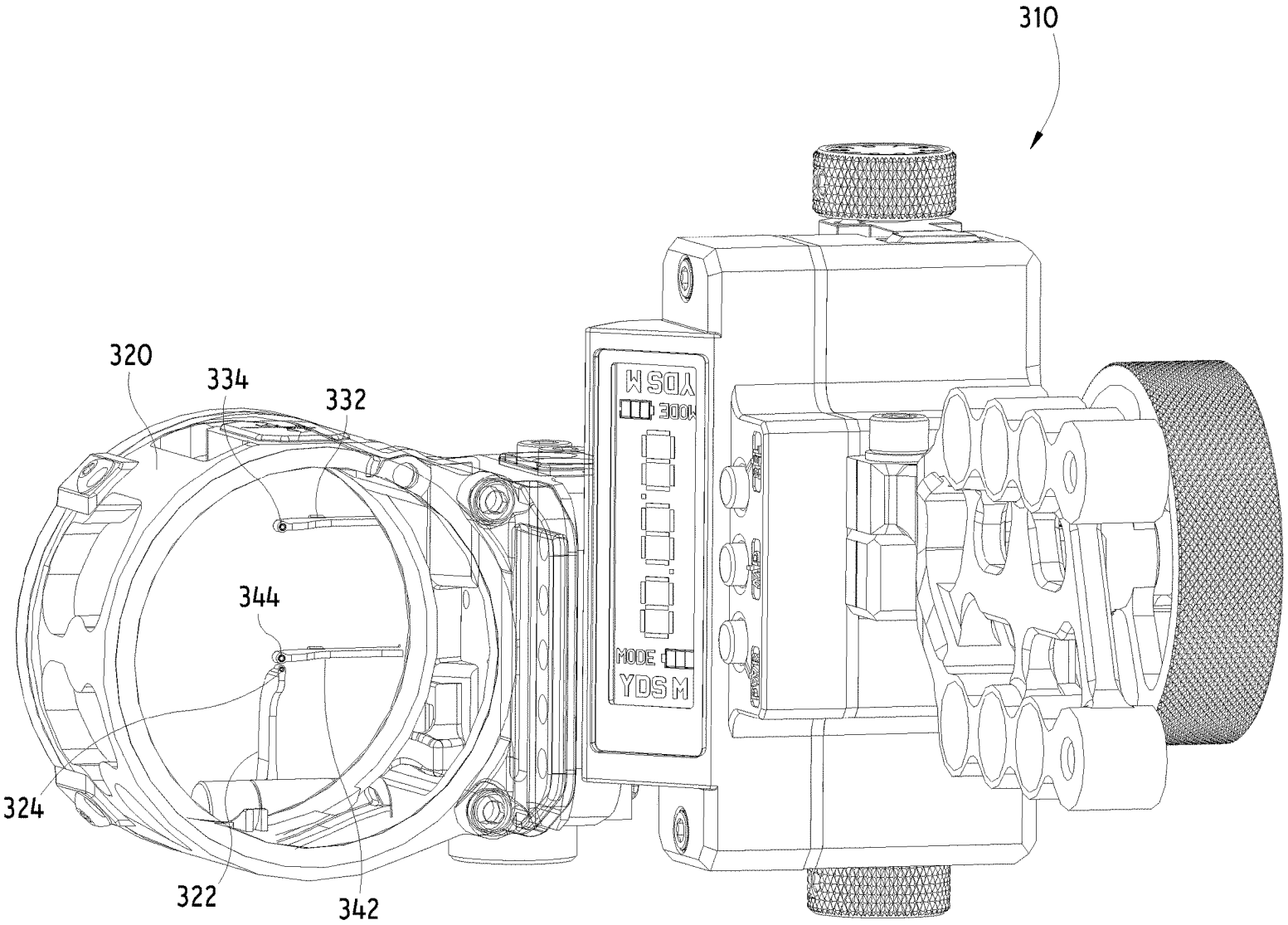
FIG. 10 is a perspective view of an archery sight according to an embodiment of the present disclosure.

FIG. 10 illustrates a further alternate embodiment of an electronic archery sight 310. Archery sight 310 in constructed in the same manner as archery sight 110, except archery sight 310 includes multiple sight pins and sight points in sight cover 320. Sight 310 is illustrated with first sight pin 322 with first sight point 324, second sight pin 332 with second sight point 334, and third sight pin 342 with third sight point 344.

In archery sight 310, the first sight pin 322 is used in conjunction with electronic module 140. The second and third sight pins 332, 342, are manually calibrated for fixed distances, such as 10 and 20 yards or 20 and 30 yards, when sight cover 320 is at a specific height, typically the top-most height.

On the three pin sight 310, the first or bottom pin 322 is used in conjunction with the electronic module. With the sight cover in a specified position, the top two pins, second pin 332 and third pin 342, are sighted in at two fixed distances, such as 20 and 30 yards or 10 and 20 yards, separately from the first or bottom pin 322. The bottom pin 322 is sighted in at a third distance such as 40 yards. After that, as the height of sight cover 320 is adjusted, the electronic module displays the target distance correlated to the adjusted height of the bottom sight pin 322. When the sight cover is moved from the specified position, second pin 322 and third pin 342 are not sighted in for specific distances.

Figure 6A:
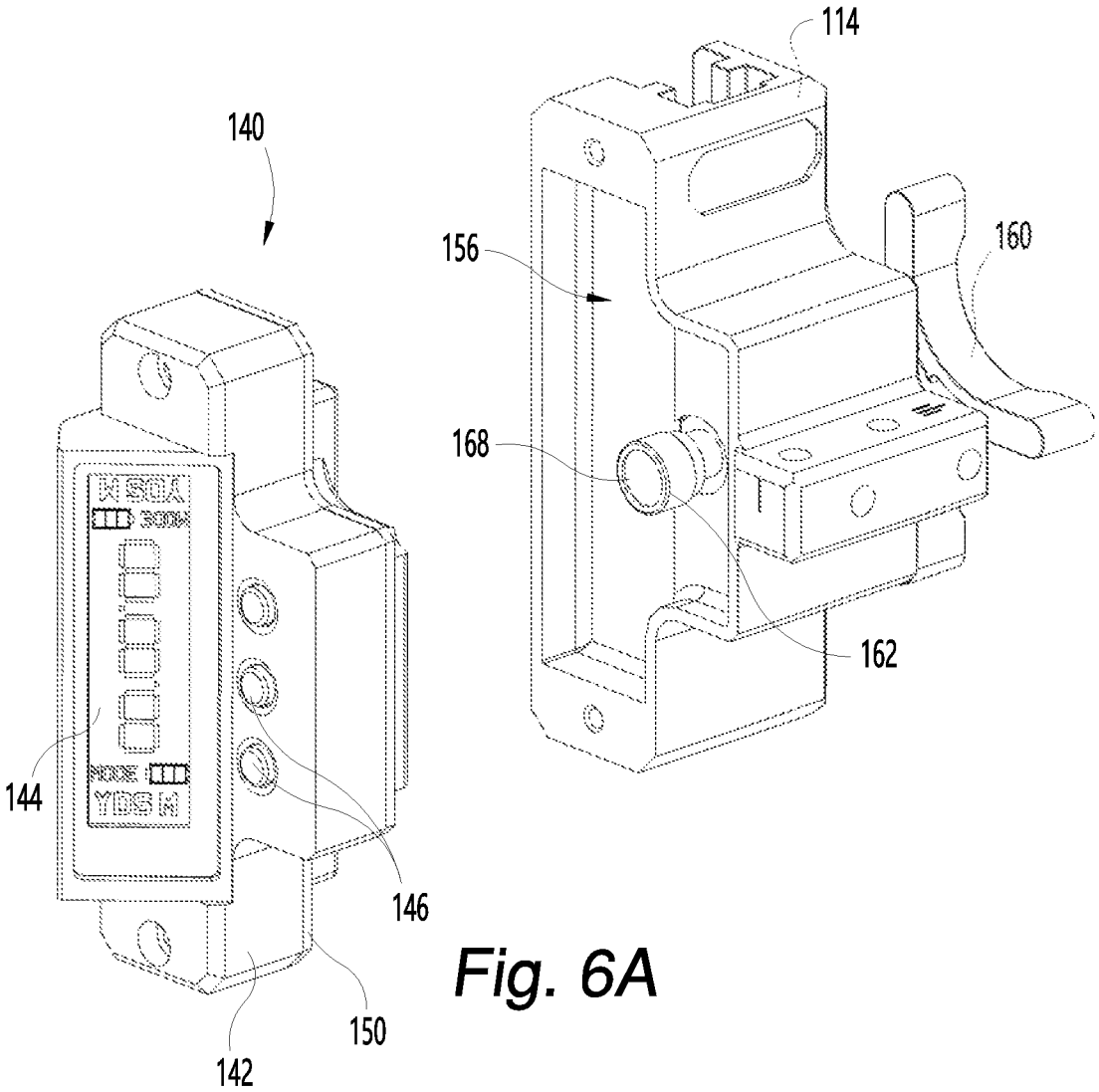
FIG. 6A is a partially exploded view of the electronic module and the sight housing of FIG. 2.
Figure 6B:
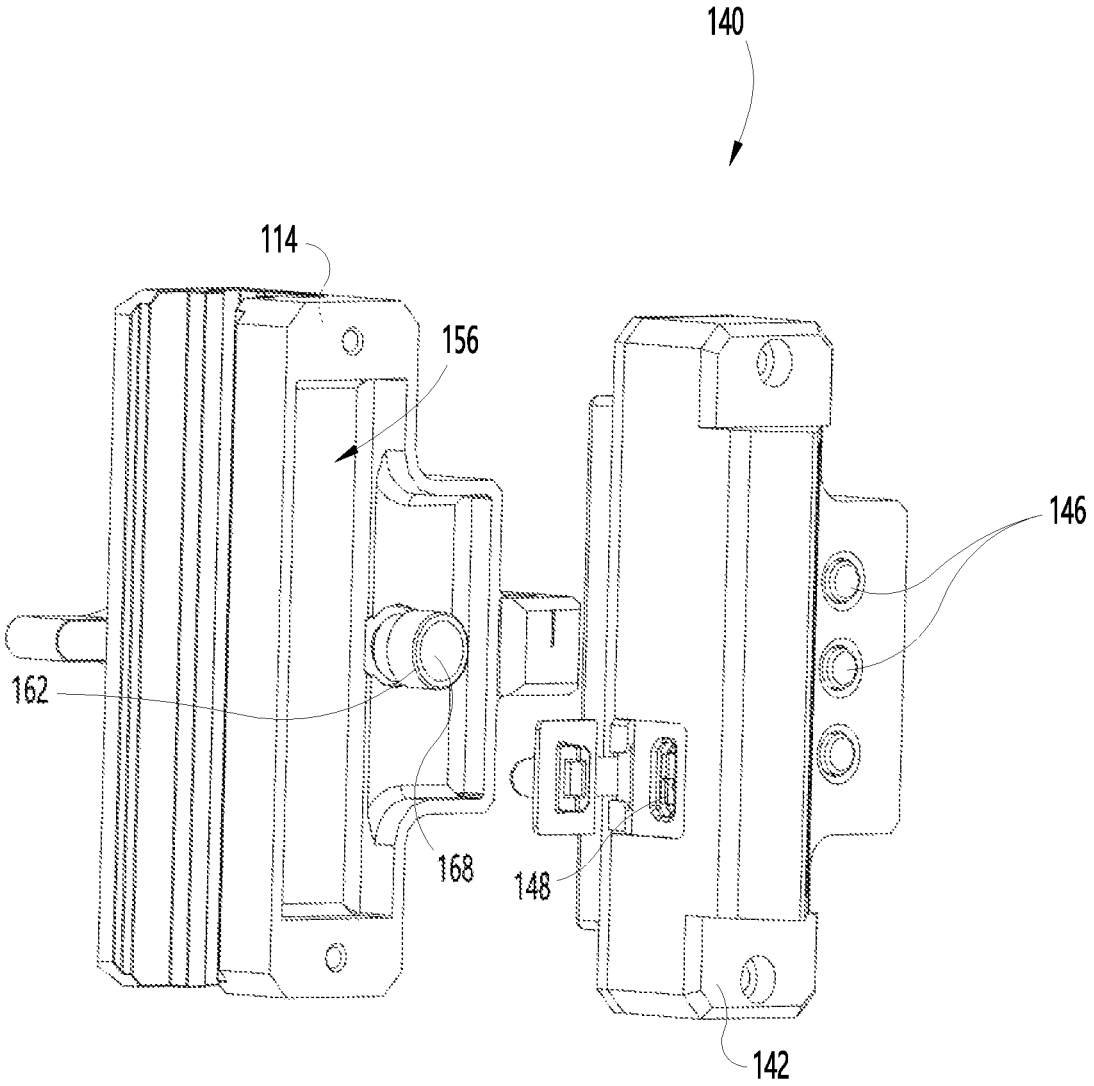
FIG. 6B is an alternate perspective partially exploded view of the electronic module and the sight housing of FIG. 6A.
Figure 6C:
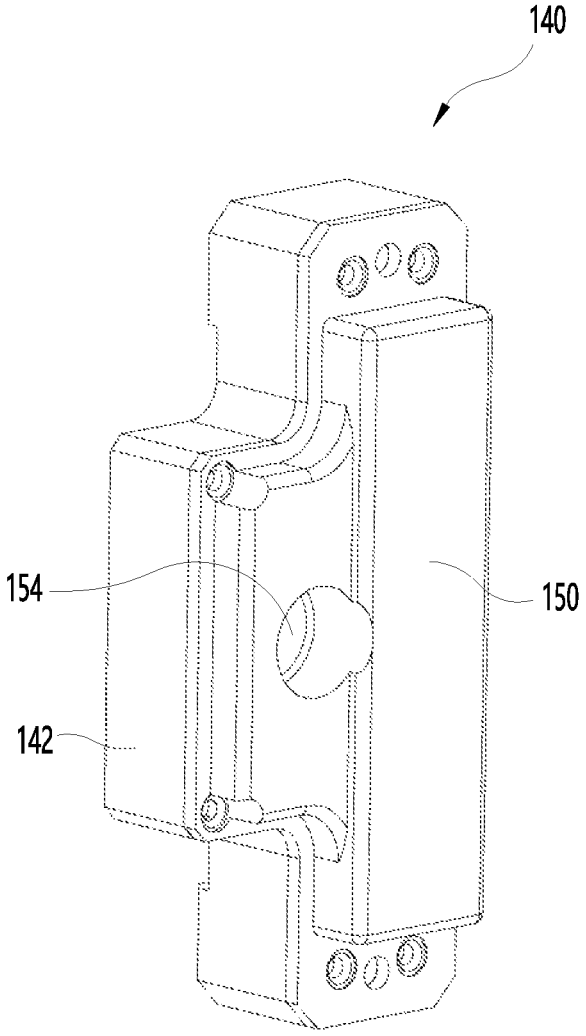
FIG. 6C is a perspective rear view of an electronic module according to an embodiment of the present disclosure.

Sights 110, 210 and 310 includes electronic module 140 mounted to the sight housing. FIGS. 6A-C illustrate detailed views of electronic module 140. Electronic module 140 includes front casing 142 and rear casing 150. Display 144 is located in front casing 142 and oriented so that the displayed information is visible to an archer. Display 144 may be an LED or LCD screen, which shows text or icons to the archer, for example displaying a target distance in yards or meters, displaying a bow speed, displaying the battery life remaining, etc.

Electronic module 140 includes one or more control buttons 146 to control the electronic module with functions such as for on/off power, for selecting between modes, to adjust and set values and otherwise for programming the module. Optionally, electronic module 140 includes a control port 148, for instance a USB or micro-USB port, to which a charger and/or a programming cable can be connected. Further optionally, sight 110 may include a removable cover to protect control port 148 from debris, moisture and/or impacts when not in use. Rear housing 150 defines a shaft cavity 154.

Electronic module 140 is mounted to sight housing 114 by emplacing the electronic module and then securing it in place. As shown in FIGS. 6A & 6B, in the illustrated embodiment, the exterior profile of rear casing 150 is received in a mounting cavity 156 defined in the lateral face of sight housing 114.

Electronic module 140 is designed to sense the rotation and measure the angular rotation of control shaft 162 as it is selectively rotated using control knob 160. As illustrated for example in FIGS. 5 & 6A, control shaft 162 extends horizontally through sight housing 114, with a suitable bore and/or bushings, and protrudes into mounting cavity 156. When assembled, an end of control shaft 162 extends into shaft cavity 154 of the electronic module.

Shaft cavity 154 is arranged to couple with the end of control shaft 162. The coupling may be a mechanical coupling, an electronic coupling or a magnetic coupling. In the illustrated embodiment, a magnetic coupling is used. Magnet 168 is fixedly mounted to a cup on the end of control shaft 162 so that magnet 168 is received in shaft cavity 154. In this embodiment, electronic module 140 incorporates at least one magnetic sensor adjacent to shaft cavity 154 to measure the angular rotation of magnet 168 and control shaft 162. In alternate embodiments, a rotary encoder or a rack and pinion gear may be used as mechanical couplings. In further alternate embodiments, an electronic coupling, for instance a potentiometer based on a variable resistor, may be used.

Electronic module 140 internally includes a processor, a memory with programming, a power supply, buttons, circuitry and related components. Once the angular rotation of control shaft 162 is measured, the processor and programming use the measured rotation to calculate the then-current height of sight point 124. The calculations may be based on the range formula, a programmed algorithm or empirical data. Electronic module 140 then uses the proportional distance of sight point 124 from a calibrated position to calculate and show on display 144 the target distance of sight 110 corresponding to adjusted height of sight point 124.

In certain embodiments, the electronic module is able to accurately calculate and display different target distances scaled in increments of one unit at a time in yards or meters, e.g. 20 yards, 21 yards, 22 yards . . . . In certain preferred embodiments, the electronic module is able to accurately calculate and display different target distances scaled in increments of less than one unit at a time in yards or meters, e.g. 20.1 yards, 20.2 yards, 20.3 yards, . . . . In alternate embodiments, the electronic module may be less precise, for instance displaying target distances scaled in increments of 2, 5 or 10 yards.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed:

1. A sight for an archery bow, comprising:

a. a base configured to be mounted to an archery bow;

b. a housing connected to the base;

c. a sight cover defining a sight window mounted to the housing with a bracket arrangement, wherein the sight cover is vertically adjustable relative to the housing;

d. a sight point mounted within the sight window;

e. wherein a first known height of the sight point relative to the housing is calibrated to a first known target distance;

f. wherein a second known height of the sight point relative to the housing is calibrated to a second known target distance;

g. a control knob with a control shaft extending horizontally through and rotatably coupled to the housing and operatively coupled to the bracket arrangement, wherein rotation of the control knob and control shaft vertically adjusts a height of the sight cover and the sight point relative to the housing; and h. an electronic module mounted to the housing, the electronic module having a display and at least one sensor to measure angular rotation of the control shaft;

i. the electronic module including a processor and a memory with programming, wherein the processor and programming use the measured angular rotation of the control shaft to calculate a height of the adjusted sight point relative to the first known height and the second known height, and wherein the electronic module then displays a calculated target distance corresponding to the adjusted sight point height;

j. wherein the electronic module includes a front casing and a rear casing, wherein the display, the processor, the memory, circuitry and a power supply are enclosed by the front casing and the rear casing, and wherein the rear casing defines a shaft cavity into which an end of the control shaft extends.

2. The sight for an archery bow of claim 1, wherein the electronic module is magnetically coupled with an end of the control shaft.

3. The sight for an archery bow of claim 1, comprising a magnet mounted to an end of the control shaft, and wherein the electronic module includes at least one magnetic sensor to measure angular rotation of the magnet.

4. The sight for an archery bow of claim 1, wherein the control knob is arranged on the control shaft on a lateral opposite side of the housing from the sight cover.

5. A sight for an archery bow, comprising:

a. a base mounted to an archery bow;

b. a housing connected to the base;

c. a sight cover defining a sight window mounted the housing with a bracket arrangement, wherein the sight cover is vertically adjustable relative to the housing;

d. a sight point mounted within the sight window;

e. wherein a known height of the sight point relative to the housing is calibrated to a known target distance;

f. a control knob with a control shaft extending horizontally through and rotatably coupled to the housing and operatively coupled to the sight cover, wherein rotation of the control knob and control shaft vertically adjusts a height of the sight cover and the sight point relative to the housing; and g. an electronic module mounted to the housing, the electronic module having a display and at least one sensor to measure angular rotation of the control shaft;

h. the electronic module including a processor and a memory with programming, wherein a bow speed is saved in the memory, wherein the processor and programming use the measured angular rotation of the control shaft to calculate an adjusted sight point height relative to the known height and the saved bow speed to calculate and display a target distance corresponding to the adjusted height of the sight point;

i. wherein the electronic module includes a front casing and a rear casing, wherein the display, the processor, the memory, circuitry and a power supply are enclosed by the front casing and the rear casing, and wherein the rear casing defines a shaft cavity into which an end of the control shaft extends.

6. The sight for an archery bow of claim 5, wherein the electronic module is magnetically coupled with an end of the control shaft.

7. The sight for an archery bow of claim 6, comprising a magnet mounted to the end of the control shaft, and wherein the electronic module includes at least one sensor to measure angular rotation of the magnet.

8. The sight for an archery bow of claim 7, wherein the rear casing defines a shaft cavity wherein the magnet extends into the shaft cavity.

* * * * *